US011987336B2

(12) United States Patent
Sharp

(10) Patent No.: US 11,987,336 B2
(45) Date of Patent: May 21, 2024

(54) EXHAUST PIPE COUPLING

(71) Applicant: Robert John Sharp, Camarillo, CA (US)

(72) Inventor: Robert John Sharp, Camarillo, CA (US)

( * ) Notice: Subject to any disclaimer, the term of this patent is extended or adjusted under 35 U.S.C. 154(b) by 0 days.

(21) Appl. No.: 17/324,285

(22) Filed: May 19, 2021

(65) Prior Publication Data

US 2022/0371716 A1 Nov. 24, 2022

(51) Int. Cl.

| | |
|---|---|
| ***B63H 21/34*** | (2006.01) |
| ***F01N 1/08*** | (2006.01) |
| ***F01N 13/10*** | (2010.01) |

(52) U.S. Cl.

CPC ..... *B63H 21/34* (2013.01); *F01N 1/083* (2013.01); *F01N 13/10* (2013.01)

(58) Field of Classification Search

CPC ..... F01N 1/083; F01N 13/10; F01N 2590/02; F23J 11/00; F23J 2219/10; B63H 21/32

USPC ..... 440/89 R, 88 R; 60/281–285; 141/279, 141/387, 388; 110/121, 217; 55/385.1

See application file for complete search history.

(56) References Cited

U.S. PATENT DOCUMENTS

| | | | | |
|---|---|---|---|---|
| 4,637,300 | A * | 1/1987 | Cole | B01D 46/0005 126/307 R |
| 5,980,343 | A * | 11/1999 | Rolinski | F01N 13/12 440/89 R |
| 8,402,746 | B2 * | 3/2013 | Powell | B08B 15/00 60/284 |
| 11,325,687 | B1 * | 5/2022 | Sharp | B63H 21/32 |
| 2018/0290864 | A1 * | 10/2018 | Garitaonandia Aramberri | E04H 12/348 |
| 2022/0073181 | A1 * | 3/2022 | Sharp | B63B 1/04 |

* cited by examiner

*Primary Examiner* — Kenneth J Hansen
*Assistant Examiner* — Kelsey L Stanek

(57) ABSTRACT

An oceangoing vessel exhaust pipe coupling used to temporarily couple to an oceangoing vessel exhaust pipe. Installation and removal of the coupling only requires a simple mechanism with three translational degrees of freedom and one rotational degree of freedom, thereby enabling remote coupling. The coupling adapts to a wide array of exhaust pipe shapes and sizes. This is accomplished by a unique shape that allows stable and balanced resting position on top of an exhaust pipe as well as a two-chamber configuration, wherein the two chambers are separated by a permeable partition. Furthermore, the unique shapes of the chambers deflect the exhaust gas stream towards the outlet of the coupling, regardless of exhaust pipe style, thereby increasing capture efficiency and extending the life of an attached fabric flexible hose.

20 Claims, 13 Drawing Sheets

BOTTOM VIEW

BOTTOM VIEW

EXHAUST PIPE COUPLING

CROSS-REFERENCE TO RELATED APPLICATIONS

None.

FEDERALLY SPONSORED RESEARCH

None.

SEQUENCE LISTING

None.

BACKGROUND

Emissions sources produce harmful air contaminants such as particulate matter (PM) and oxides of nitrogen ($NO_x$). The United States Environmental Protection Agency (EPA) and state and local agencies continue to tighten maximum emission limits. In order to meet increasingly stringent regulations, engine and boiler manufacturers and operators install exhaust treatment systems to remove emissions from the exhaust stream before release to the atmosphere.

Emissions sources may contain boilers and/or internal combustion engines. Emissions sources are categorized as either stationary sources or mobile sources. Examples of stationary sources include fixed electrical power generators and power plants. Examples of mobile sources include cars, trucks, tractors, locomotives, boats, ships, oceangoing vessels (OGV's) and mobile electrical power generators.

Many mobile sources are already equipped with close-coupled, dedicated exhaust treatment, where each engine or boiler is equipped with its own exhaust treatment that travels with the mobile source. However, engines and/or boilers on some mobile sources do not have dedicated exhaust treatment that travels with the mobile source. In these cases, a temporarily coupled remote emissions control system may be used. A remote emissions control system may temporarily couple to the mobile source while the mobile source remains in one location but still generates emissions.

One example of temporary coupling to a mobile source is an oceangoing vessel at berth in which the vessel's auxiliary generator(s) and/or boiler(s) continue to operate while at berth. Another example is a stopped or slow-moving locomotive in a railyard which continues to generate emissions. For these types of emissions sources, an emissions control system may couple temporarily to the mobile source at the mobile source's exhaust pipe.

In the case of the vast majority of oceangoing vessels (OGV's), one exhaust pipe is dedicated to each engine or boiler within the OGV. Each exhaust pipe is routed from the engine or boiler, each located in the engine room within the hull of the OGV, up through the ship's stack/funnel, where the exhaust pipes penetrate a deck at the top of the ship's stack. Each of the exhaust pipes extend vertically beyond the deck to sufficiently clear the top of the ship's stack to direct the exhaust away from the OGV.

The top aspect of these OGV exhaust pipes can have various exit configurations ranging from straight up to angled-over by as much as ninety degrees. In a straight up configuration, the exhaust exits vertically and there is no bend at the top aspect of the exhaust pipe. The most common exhaust pipe configuration, by far, is the angled-over configuration. The angled-over configuration is popular because it helps to prevent rain from entering the exhaust pipe. The angled-over configuration also helps to direct the exhaust stream away from the direction of travel, thus helping to keep the exhaust gas away from the vessel when underway.

Angled-over OGV exhaust pipes are typically constructed from a pipe that is cut at an angle into two pieces. One of the pieces is rotated along its longitudinal axis 180 degrees relative to the other piece and then the two pieces are welded back together. This has the effect of causing a bend in the pipe. This procedure may be repeated until the desired shape is achieved. This type of method may be used for many different shapes of angled exhaust pipe exists. A curved piece of pipe also be used to construct an angled-over exhaust pipe.

An early approach to OGV exhaust pipe coupling consisted of an inverted funnel-shaped collection hood which were modeled after typical fume extraction hoods that have been used for many other purposes. Collection hoods in general work on the principle that a slip stream of outside air covers the fumes and draws the fumes with the air into the collection hood. Typically fume extraction hoods are separated by a gap from the fume source.

A disadvantage of collection hoods is the gap between the hood and the exhaust pipe which allows exhaust gas to escape if not counteracted with excessive suction that draws outside air in addition to the exhaust gas. A disadvantage of ingesting this outside air is that it requires the entire system to process significantly more gas (exhaust gas plus outside air). This, in turn, causes the ducting to be larger and the treatment system to be larger which increases capital cost. A further disadvantage of processing the additional gas volume is increased energy cost.

A further disadvantage of collection hoods when used for oceangoing vessels is that both the collection hood and the oceangoing vessel are typically in motion due to rolling, pitching, surging, and/or wind. Thus, when a collection hood is positioned over an exhaust pipe of an oceangoing vessel, there is a tremendous about of relative motion between them, which reduces capture efficiency.

A further disadvantage of the collection hoods is they are only effective for straight up exhaust pipes that exit vertically. An inverted funnel that is typically lowered from above with a crane. In this case, it is relatively easy to align vertical axis of the inverted cone collection hood with the vertical exhaust pipe below. In this case, the force of gravity is parallel with both the axis of the exhaust pipe exit and the axis of the collection hood.

However, if the exhaust pipe is angled-over, then the axis of the collection hood has to be positioned along the same axis of the exhaust pipe exit. In this angled-over case, the force of gravity is no longer parallel with the exit of the exhaust pipe nor the axis of the collection hood. Thus, the force of gravity tends to pull the hood away from the exhaust pipe which requires an opposing force to maintain the position of the collection hood. This is a disadvantage because it is significantly more difficult to maintain the proper orientation of the collection hood both during coupling and while the system is operating. This difficulty is increased during high winds and/or relative motion caused by rolling and pitching motion of the vessel(s).

An angled exhaust pipe exit is typically not cut perpendicular to the longitudinal axis of the exhaust pipe. Most angled exhaust pipe exits are cut so that the exit is vertical in profile or there is even a slight overhang on the top in an effort to reduce the chance of rain entering the pipe from above. Thus, the cross section of an angled-over exhaust pipe exit is likely to be an oval instead of a circle because the pipe is cut at an angle rather than perpendicular across the pipe. In the case of a typical collection hood, however, the shape of the inverted funnel is typically circular. Thus, the shape of and angled exhaust pipe exit does not match the shape of the collection hood, leaving a significant gap on three sides. An oval collection hood cold be built, but then it would not be compatible with the round exhaust pipe exists. Furthermore, if the collection hood is to the side of the exhaust pipe in order to align with the exhaust pipe exit, there will be more opportunity to lose exhaust gas as the hot gas tends to rise vertically and escape between the gap between the exhaust pipe and the collection hood. Thus, an angled-over exhaust pipe when used in conjunction with an inverted funnel collection hood has a significant disadvantage of allowing even more outside air through the gap caused by the shape mismatch and a further disadvantage of losing some of the exhaust gas through the gap. Furthermore, the outside air is drawn into the collection hood asymmetrically, which has the disadvantage of causing a flow disturbance which may reduce the capture efficiency of the hood.

A further disadvantage of collection hoods when used with angled-over exhaust pipes is the hood must be positioned in space in six degrees of freedom (6DOF) (three translational degrees of freedom and three rotational degrees of freedom) in order to align the exhaust pipe exit axis with the collection hood axis.

Thus, there remains a need for a universal temporary coupling device for the extraction of exhaust gas from mobile sources for processing, treatment, and/or testing. Furthermore, it is desirable that the coupling facilitates remote connection, thus eliminating the necessity for person (s) to directly manipulate the coupling onto each exhaust pipe.

SUMMARY

A coupling used to temporarily couple to an oceangoing vessel exhaust pipe. Installation and removal of the coupling only uses, in an exemplary embodiment, a simple mechanism with three translational degrees of freedom and only one rotational degree of freedom, thus enabling simple remote coupling. The coupling adapts to a wide array of exhaust pipe shapes and sizes. This is accomplished by a novel and unique shape that allows stable and balanced resting position on top of an exhaust pipe as well as a two-chamber configuration, wherein the two chambers are separated by a permeable partition. Furthermore, the unique shapes of the chambers deflect the exhaust gas stream towards the outlet of the coupling, regardless of exhaust pipe shape, thus increasing capture efficiency and extending the life of an attached fabric flexible hose.

DRAWINGS—FIGURES

The novel features which are characteristic of the present invention are set forth in the appended claims. However, embodiments, together with further objects and attendant advantages, will be best understood by reference to the following detailed description taken in connection with the accompanying drawings in which:

DETAILED DESCRIPTION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

The details of one or more embodiments of the invention are set forth in the accompanying drawings and the description below. Other features, objects, and advantages of the invention will be apparent from the description and drawings, and from the claims.

Figure 1:
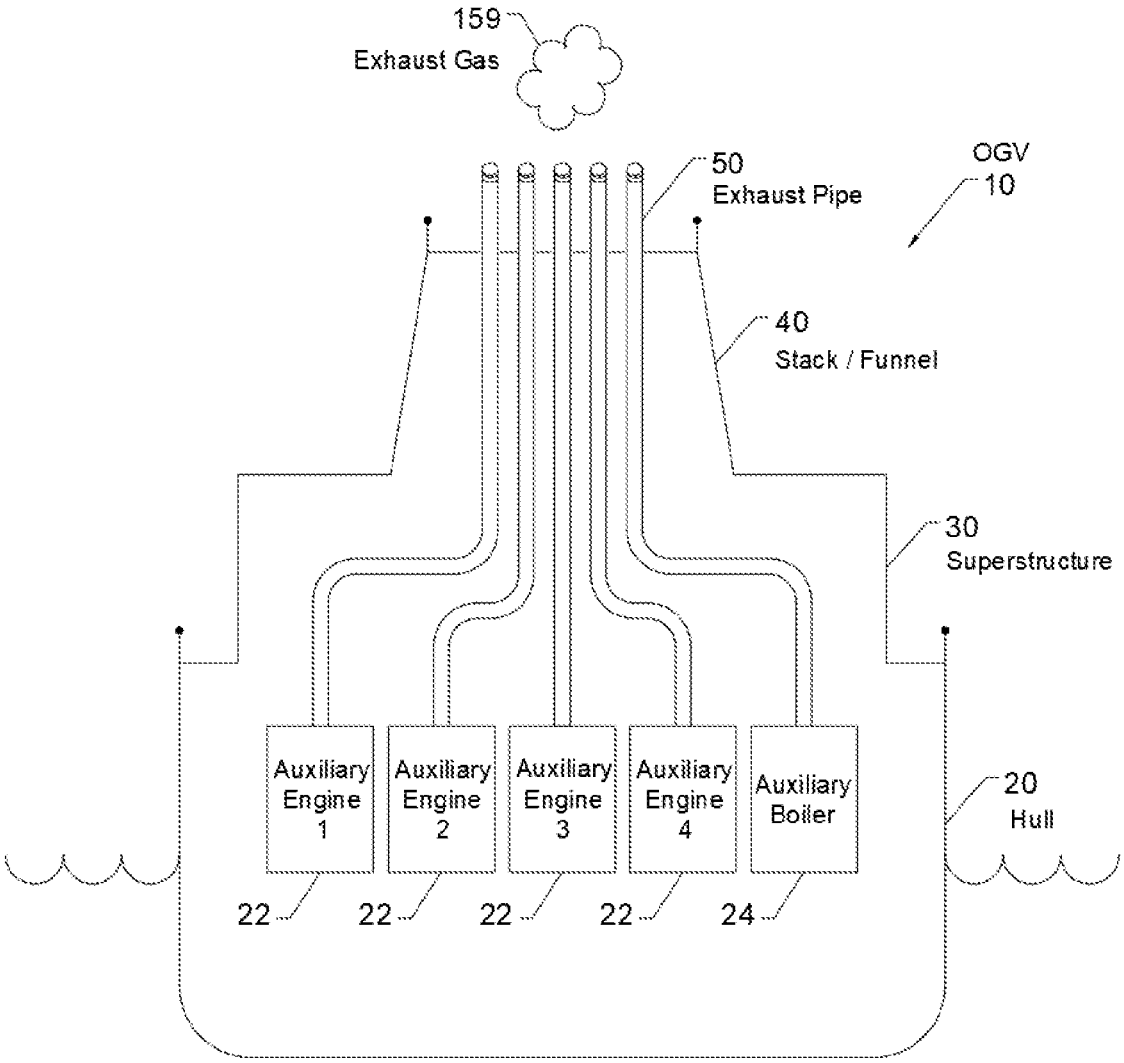
FIG. 1 shows an example exhaust system for an oceangoing vessel (OGV).

In the case of the vast majority ocean going vessels (OGV's), each exhaust pipe is dedicated to a corresponding engine or boiler within the OGV. FIG. 1 shows one OGV example with four auxiliary engines, each with its own dedicated exhaust pipe and an auxiliary boiler with its own exhaust pipe. In this example, all five exhaust pipes travel from the engine or boiler up through the ship's stack/funnel, where they penetrate a deck at the top of the ship's stack. Each of the five exhaust pipes extend up past the deck to sufficiently clear the top of the ship's stack in order to direct the exhaust away from the OGV.

Figure 2:
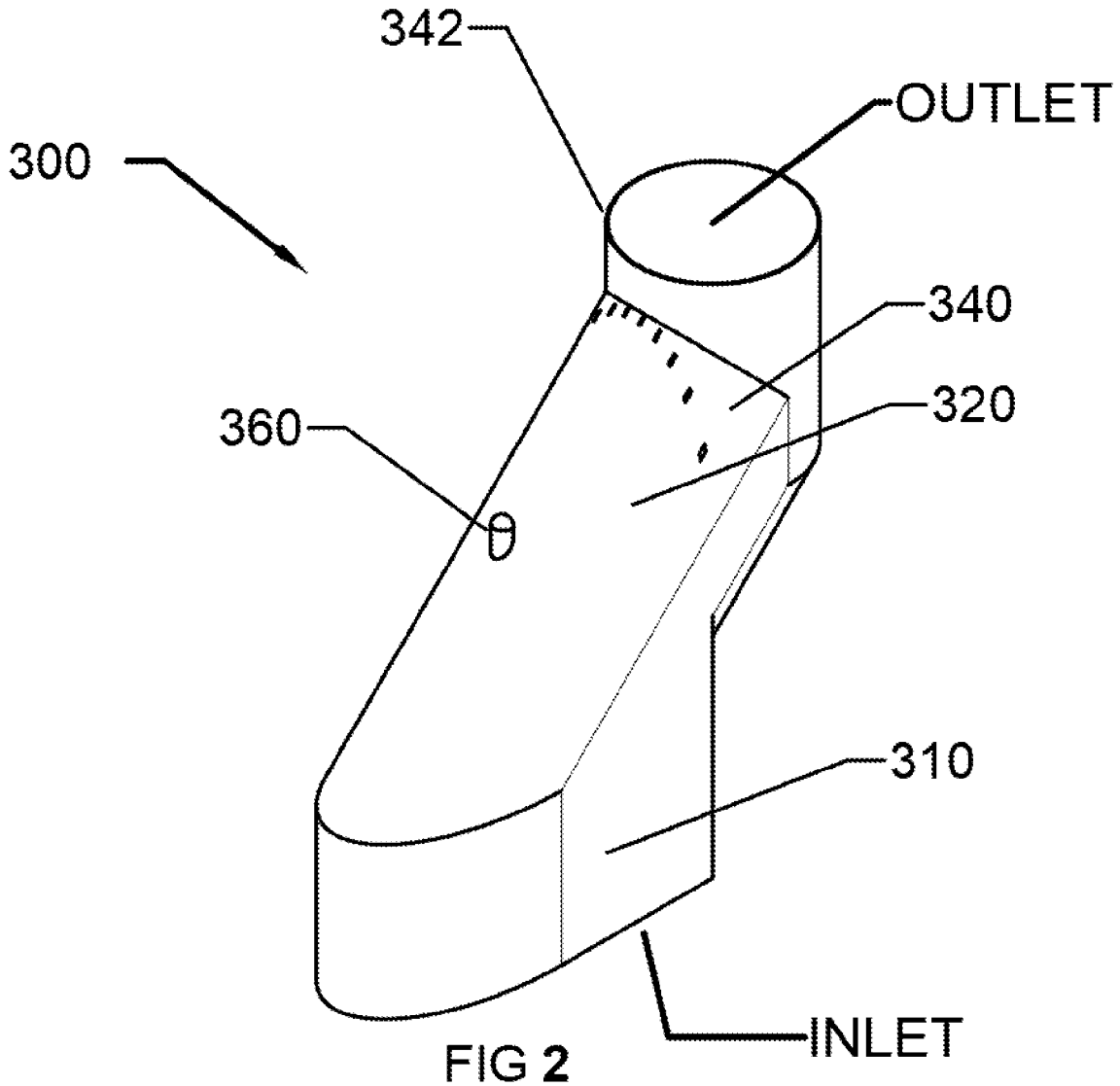
FIG. 2 shows a coupling.
Figure 3:
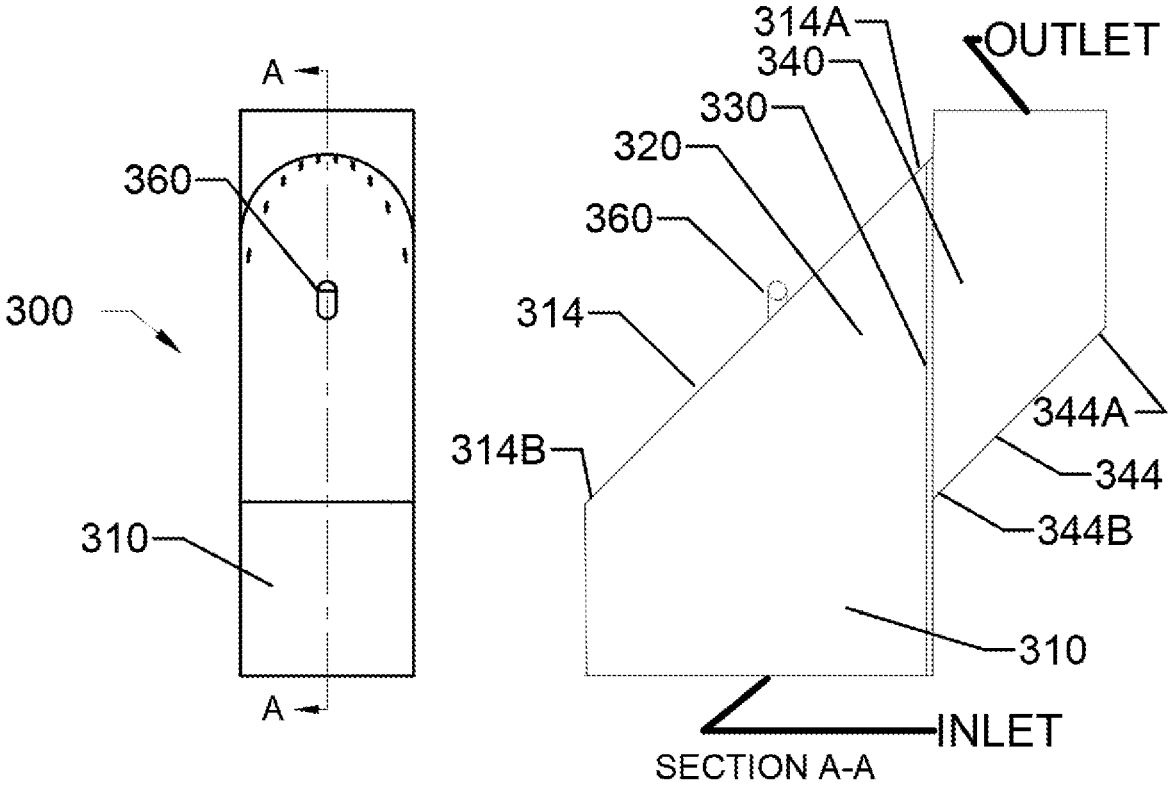
FIG. 3 shows the front view of a coupling with cross sectional view.

FIGS. 2 and 3 show an exemplary embodiment of oceangoing vessel exhaust pipe coupling 300 comprising skirt 310, inlet chamber 320, permeable partition 330 outlet chamber 340, and duct attachment adapter 342. The coupler is a closed structure except for the inlet of the inlet chamber and the outlet of the outlet chamber, so that gas may only enter or exit through the inlet and outlet openings. Inlet chamber 320 preferably has a rounded top surface 314 (FIG. 3, section A-A) to match the shape of mating exhaust pipes, although other embodiments may employ a triangular, or even flat top surface. The exhaust pipe will contact the top surface 314 as the coupler is positioned onto the exhaust pipe. The surface 314 is angled or sloped from the horizontal, with the top end 314A of the top surface higher than the lower end 314B. This shape of the inlet chamber is sometimes hereinafter referred to as "wedge-shaped," in that inlet chamber is wedge-shaped, oriented with a wide aspect extending in a downward direction, with an inlet opening at the bottom sufficiently large to fit over a top aspect of an exhaust pipe The top surface 314 will naturally through the force of gravity tend to direct the position of the exhaust pipe toward the outlet chamber, with the top surface shaped to constrain said exhaust pipe in a narrower aspect of the inlet chamber. The top surface 314 will also deflect exhaust gases from the exhaust pipe impinging on the top surface toward the outlet chamber. The rounded or triangular shapes of the top surface 314 naturally centers the exhaust pipe within inlet chamber 320.

The outlet chamber 340 communicates fluidically with the inlet chamber through the permeable partition 330, and in this exemplary embodiment is also wedge-shaped, with an angled bottom surface 344, with top end 344A of surface 344 higher than the lower end 344B. The angled surface 344 tends to deflect horizontal components of the exhaust gas flow toward the outlet. The wedge shape of the outlet chamber is inverted with respect to the wedge shape of the inlet chamber, with a wide aspect extending upwardly, with an outlet at the top for providing an exit for the exhaust gas flow.

In this exemplary embodiment, there is also an attachment device. The attachment device is typically located above the location near the center of mass of coupling 300. The center of mass of coupling 300 is ideally located near the top of the wedge-shaped of inlet chamber 320. In order to maintain this center of mass, additional weight may be added to coupling 300 as required such that coupling 300 balances sufficiently on the exhaust pipe.

The width of coupling 300 is typically slightly wider than the diameter of the largest exhaust pipe diameter that will be coupled to, ensuring a gap between the exhaust pipe and coupling 300. Smaller exhaust pipe diameters than this width will also fit but larger exhaust pipe diameters will not. Thus, coupling 300 will work for all diameter exhaust pipes up to the selected size. However, selecting coupling 300 with unnecessary width is not recommended, as this may result in difficulty when coupling exhaust pipes that are side-by-side. The typical width for coupling 300 for OGV's is about 28 inches, although the actual width will be determined by the application at hand. Larger OGV's with larger auxiliary engines may have larger diameters and smaller OGV's may have smaller diameters. Some exhaust pipes have attachments called "spark arrestors" or "soot screens" which comprise a mesh covering or a grid covering that a larger diameter than the exhaust pipe itself. These exhaust pipe attachments are commonly seen on tanker vessels. When an exhaust pipe outlet attachment is encountered, a corresponding coupling 300 is selected to accommodate the larger size. Furthermore, an expanded area within coupling 300 may be used to accommodate the larger size of the attachment. Furthermore, a special coupling 300 may be fabricated to accommodate any unusual exhaust pipe configurations, while still operating according to the principles discussed herein.

FIG. 3 shows an exemplary embodiment of coupling 300 in front view and in cross section A-A. Shown again are skirt 310, inlet chamber 320, outlet chamber 340. FIG. 3 also reveals in the cross-sectional view A-A of permeable partition 330, which separates the inlet chamber from the outlet chamber.

Attachment device 360 (FIG. 3 and A-A) is located at a balanced location such that coupling 300 hangs level when lifted at this point. Attachment device 360 is typically a pivot and coupling 300 hangs from this pivot point. Attachment device 360 is used for manipulating coupling 300 up/down, left/right, and forward/back. This may be accomplished with a simple mechanism with three degrees of freedom (translation only). A fourth degree of freedom is necessary for rotation about the vertical axis to align the exhaust pipe with coupling 300. This rotation is typically accomplished in an exemplary embodiment by rotating coupling 300, attachment device 360, and the connecting exhaust duct together as a unit.

Figure 4:
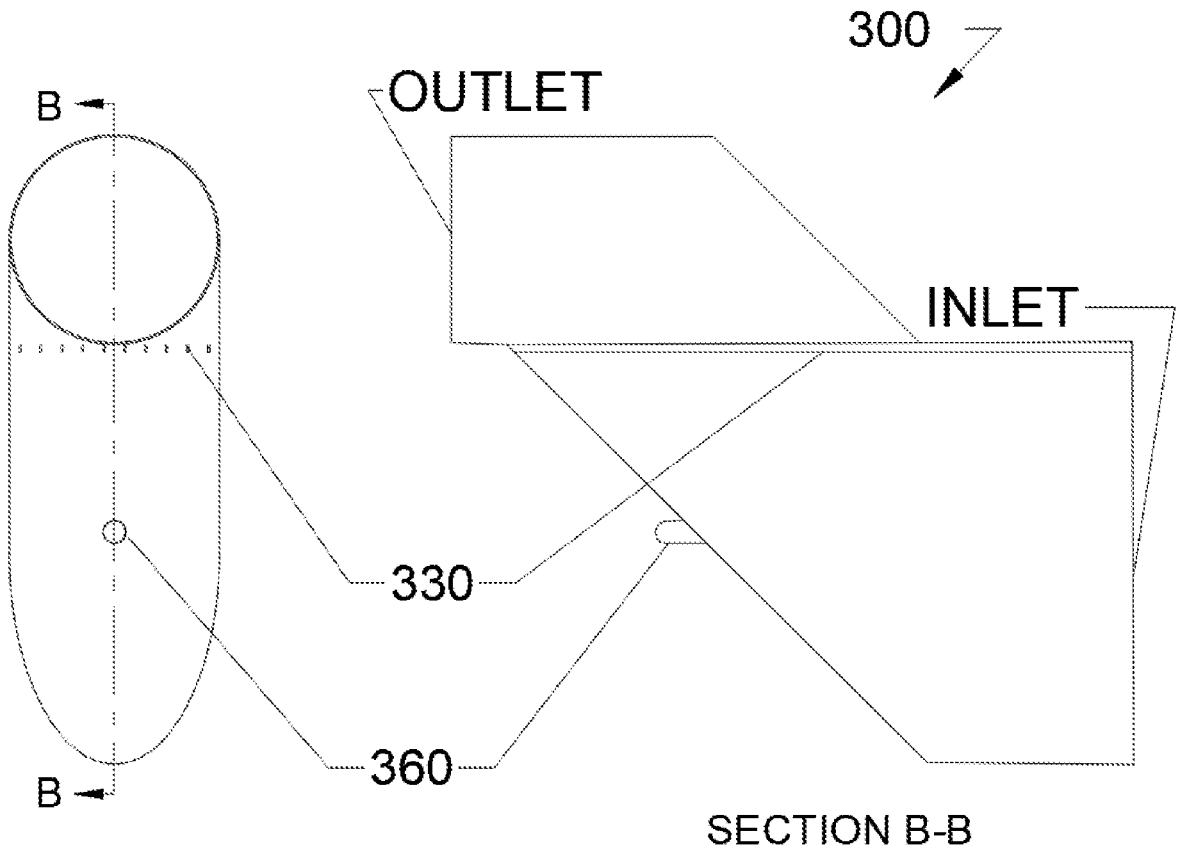
FIG. 4 shows the top view of a coupling with a cross sectional view.

FIG. 4 shows an exemplary embodiment of coupling 300 in top view and in cross section B-B. Shown again in the cross-sectional view is permeable partition 330, which separates the inlet chamber from the outlet chamber.

The material of construction for the skin of coupling 300 in this exemplary embodiment is 18-gauge stainless steel, preferably type 316, in which the shapes are cut, rolled as required, and then welded together. An alternative preferred material for the skin of coupling 300 is titanium. Thinner or thicker gauges may be used depending on the overall size of coupling 300. The metal gauge should be as light as possible to minimize weight but thick enough to prevent denting from normal operation. The material of construction in this exemplary embodiment for permeable partition 330 is stainless steel, preferably type 316, which is fashioned from 0.5-inch diameter round rod in which the resulting grid is has preferred open area of 75%. Non-round stainless-steel rod could be used, but there less chance of galling as the exhaust pipe slides over a rounded shape, at least the aspects facing inlet chamber 320 that potentially contact an exhaust pipe. Different sizes of rods or elongated elements, such as square bars, may be used depending on the requirements at hand. The partition may also be formed of a perforated plate, in another exemplary embodiment. The side of permeable partition 330 the faces inlet chamber 320 consists of vertical rods that at least cover the common opening between inlet chamber 320 and outlet chamber 340. In this exemplary embodiment, the stainless-steel rods extend from the top of the opening between inlet chamber 320 and outlet chamber 340 all the way to the bottom of skirt 310 in order to provide a bearing surface for the exhaust pipe to ride on as coupling 300 is being installed onto an exhaust pipe. Permeable partition 330 should be manufactured so that only vertical rods can make contact with an exhaust pipe, as horizontal rods can catch on the lip of an exhaust pipe as it slides up permeable partition 330 during installation. Therefore, it is recommended that the horizontal reinforcement rods be located on the outlet chamber 340 side of permeable partition 330. Additional stiffening metal may be added around attachment device 360 as required to distribute the weight of coupling 300 to the surrounding structure.

In this exemplary embodiment, a rounded edge, composed of ¼ inch stainless steel rod, is used around the exposed edges at the bottom of skirt 110. This has the benefit of adding rigidity and eliminating a possible knife-edge safety hazard.

In another exemplary embodiment, the skin of coupling 300 may be partially composed of high-temperature fabric suitable for the application. The fabric may be supported by a metal frame. One location anticipated for use of fabric in place of metal is skirt 310. Furthermore, skirt 310 may be flexible such that the skirt material would be drawn toward the exhaust pipe when a vacuum exists within inlet chamber 320 and would be pushed outward when a pressure exists within inlet chamber 320. Thus, skirt 310 serves as seal in vacuum conditions and as a pressure relief under pressure conditions.

Figure 5:
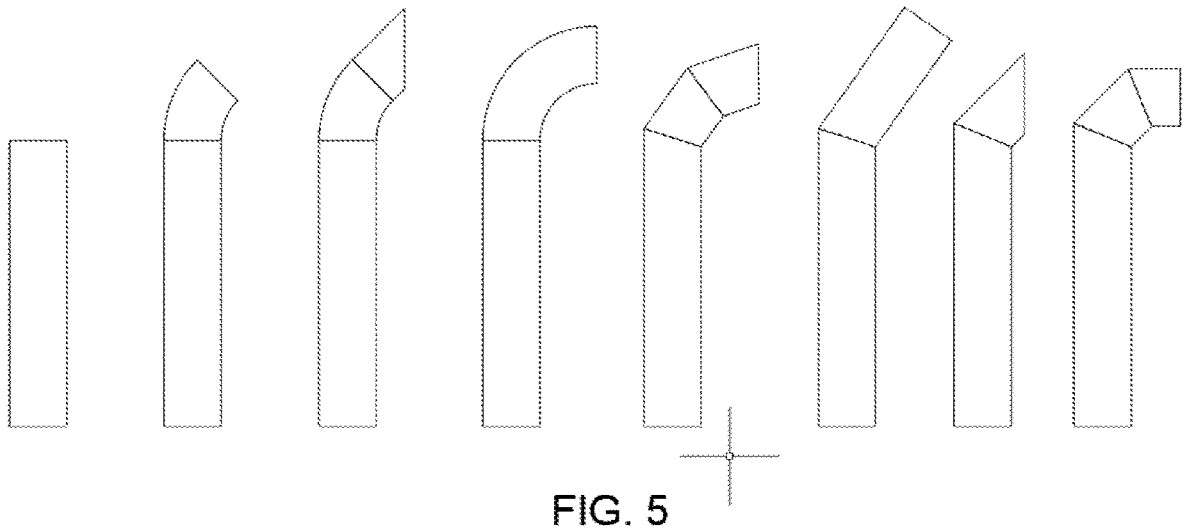
FIG. 5 shows some example of exhaust pipe shapes.

FIG. 5 shows some examples of exhaust pipe styles (configurations) typically found on oceangoing vessels (OGV's). Exhaust pipes typically exit in a range from straight up vertical (shown on left side) to angled-over horizontal (shown on the right side). Some exhaust pipes are constructed with only straight sections of pipe and others contain some curved sections of pipe.

Figure 6:
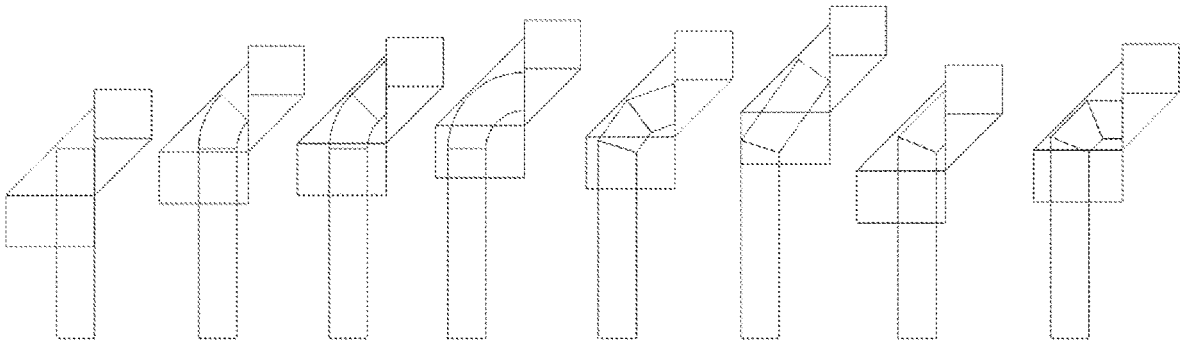
FIG. 6 shows some examples of exhaust pipe shapes with coupling installed (coupling semi-transparent).

FIG. 6 shows examples of exhaust pipe styles with coupling 300 installed.

Figure 7:
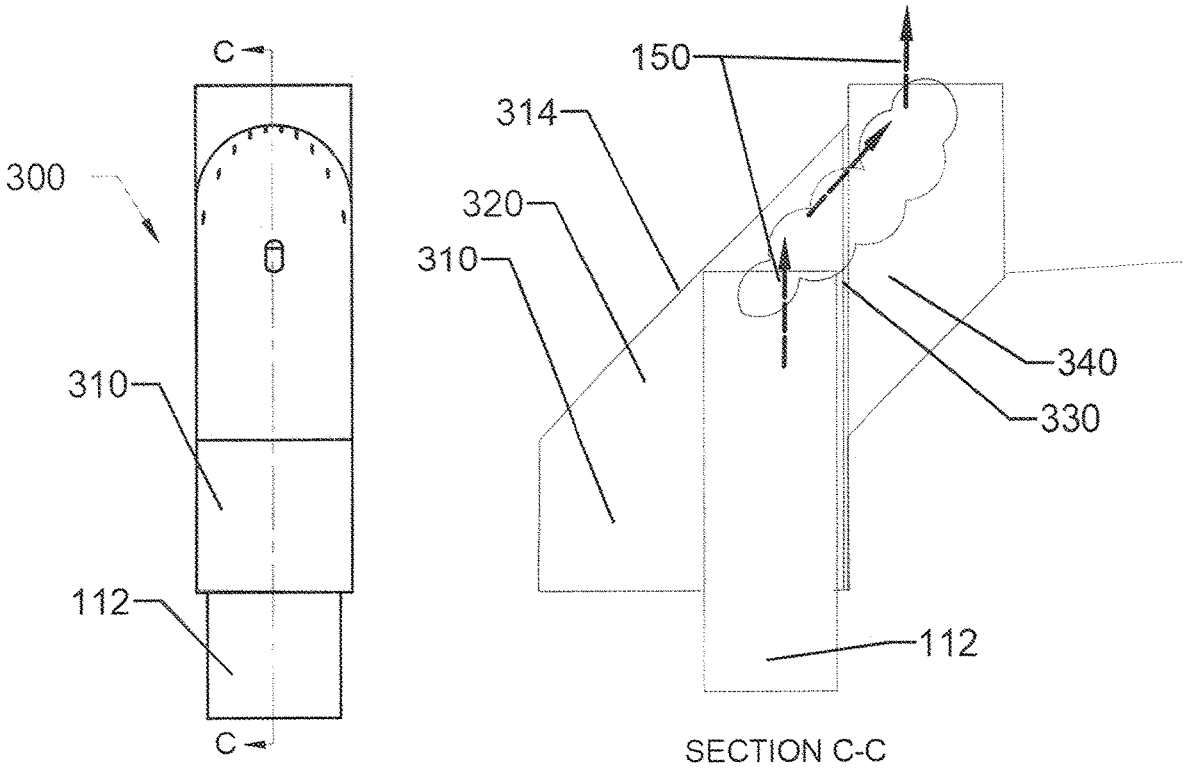
FIG. 7 shows a coupling in cross section with an example straight pipe (vertical exit).

FIG. 7 shows a cross section C-C of coupling 300 in operation with a straight-up exhaust pipe.

Figure 8:
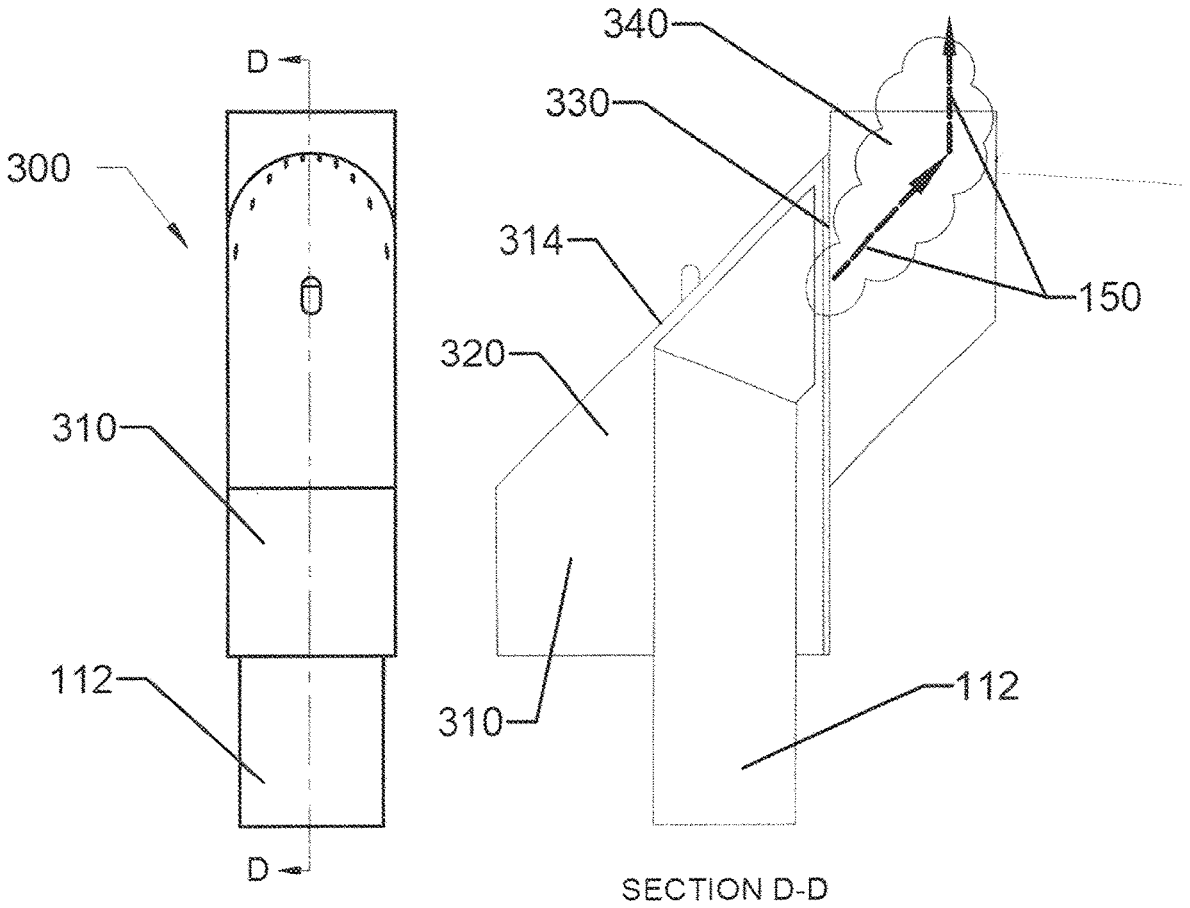
FIG. 8 shows a coupling in cross section with an example bent-over exit (~45 degree exit).

FIG. 8 shows cross section D-D of coupling 300 used in an example wherein exhaust pipe 112 is angled-over at about a 45-degree angle. This is the most typical configuration on OGV's.

Figure 9:
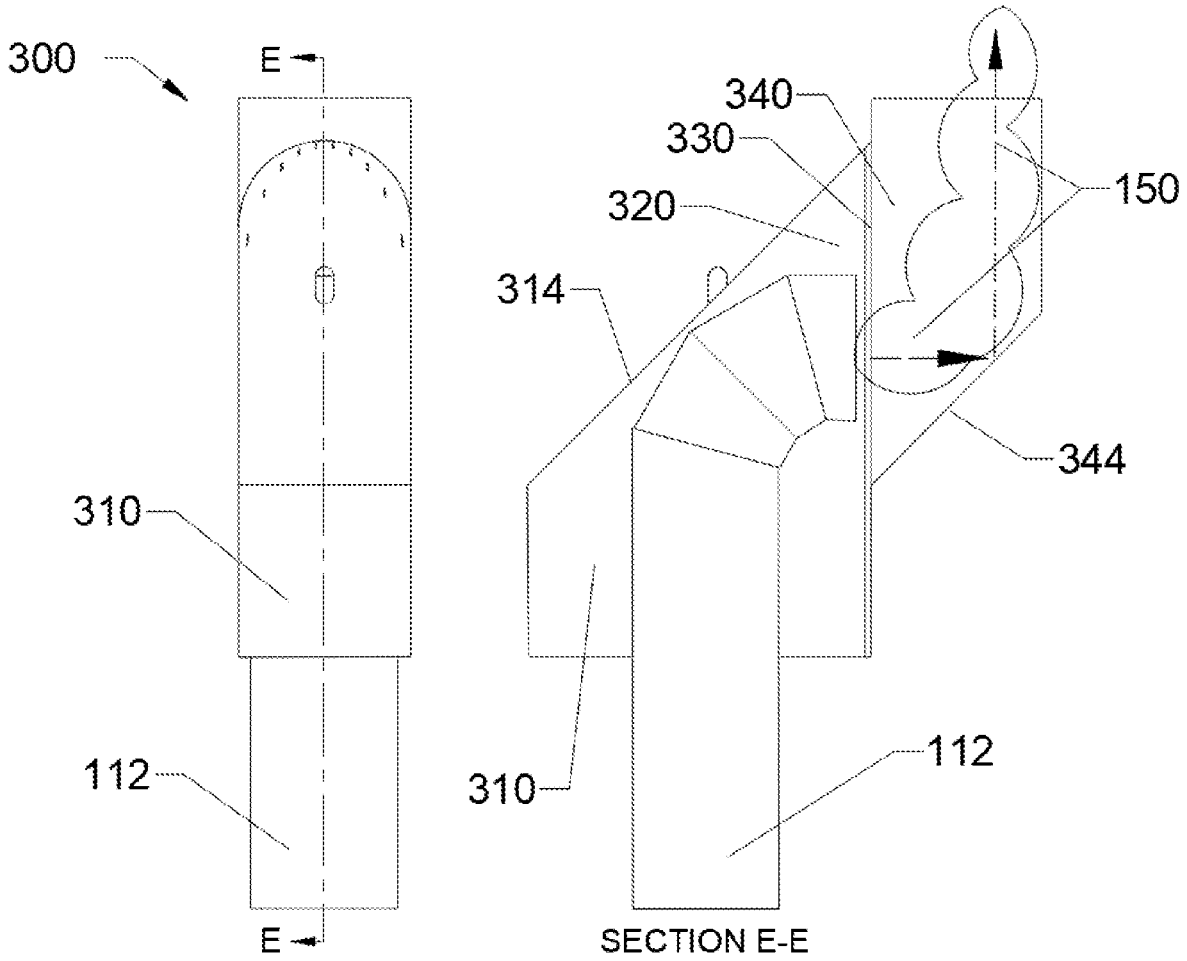
FIG. 9 shows a coupling in cross section with an example bent-over exit (~90 degree exit with sectioned pipe).

FIG. 9 shows a cross section E-E of coupling 300 in operation with a 90-degree-style exhaust pipe.

Figure 10:
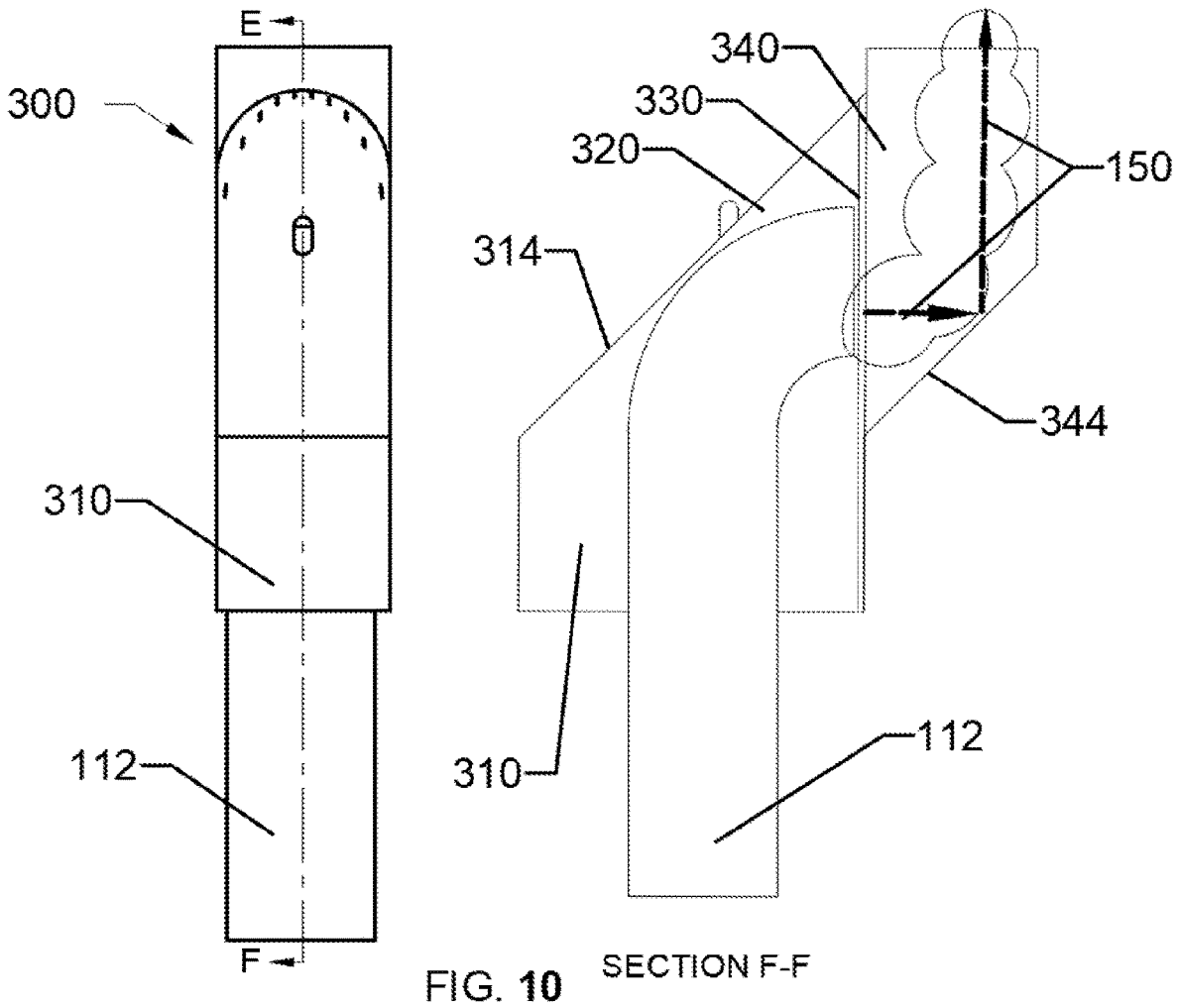
FIG. 10 shows a coupling in cross section with an example bent-over exit (~90 degree exit with curved pipe).

FIG. 10 shows a cross section F-F of coupling 300 in operation with a rounded transition exhaust pipe.

Figure 11:
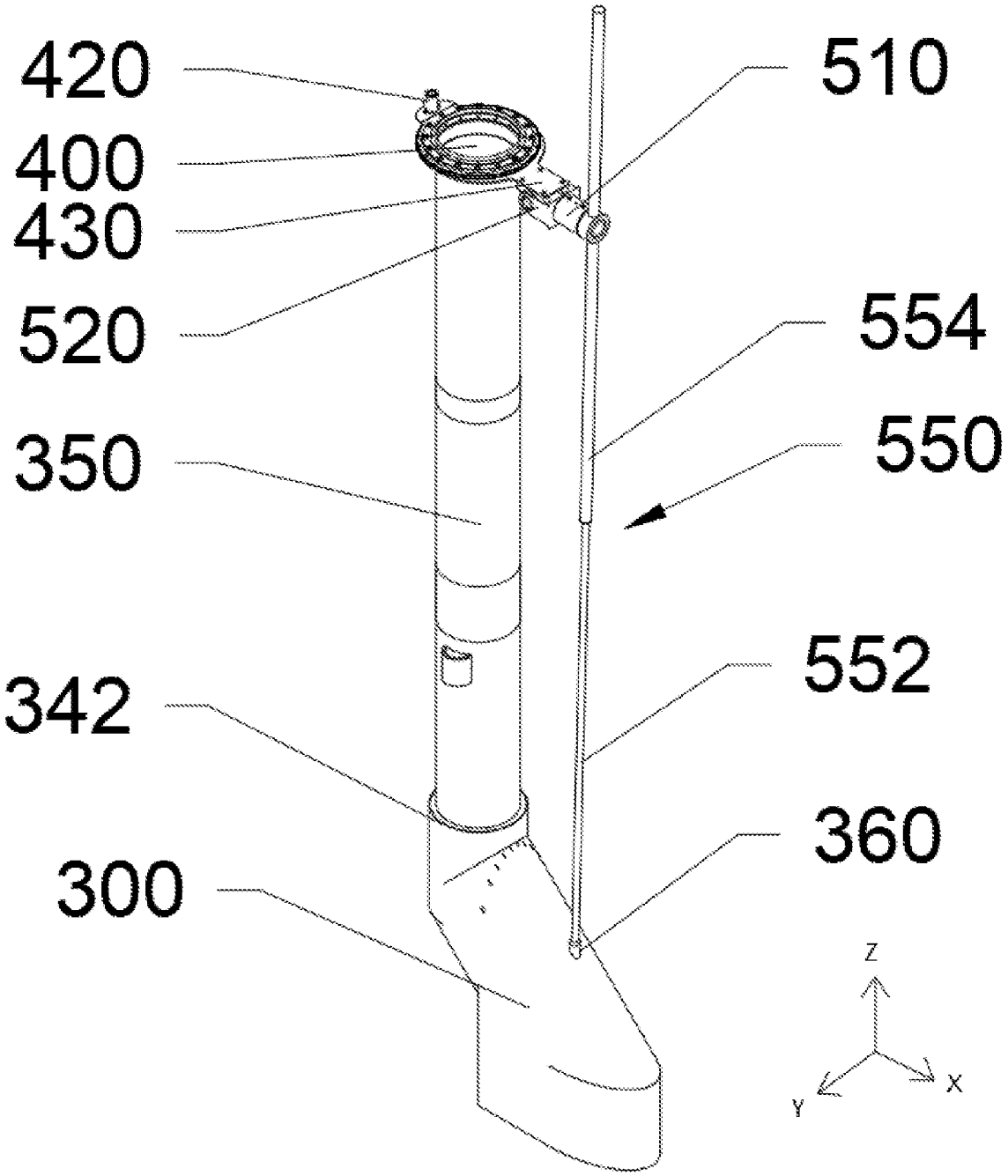
FIG. 11 shows a coupling with an example of a positioning mechanism.

FIG. 11 shows an example positioning mechanism whereas coupling 300 is in fluid connection with outlet duct 350. At the opposite end of outlet duct 350 is Z duct swivel 400 which comprises Z duct swivel motor 420 and Z duct swivel mounting tab 430. Mounted to Z duct swivel mounting tab 430 is Y actuator 520 Mounted to the outlet of Y actuator 520 is X actuator 510. Mounted to the outlet of X actuator 510 is Z actuator 550. Z actuator 550 comprises Z actuator cylinder 554 and Z actuator push rod 552. Z actuator push rod 552 is attached to a pivot on coupling attachment device 360.

Figure 12:
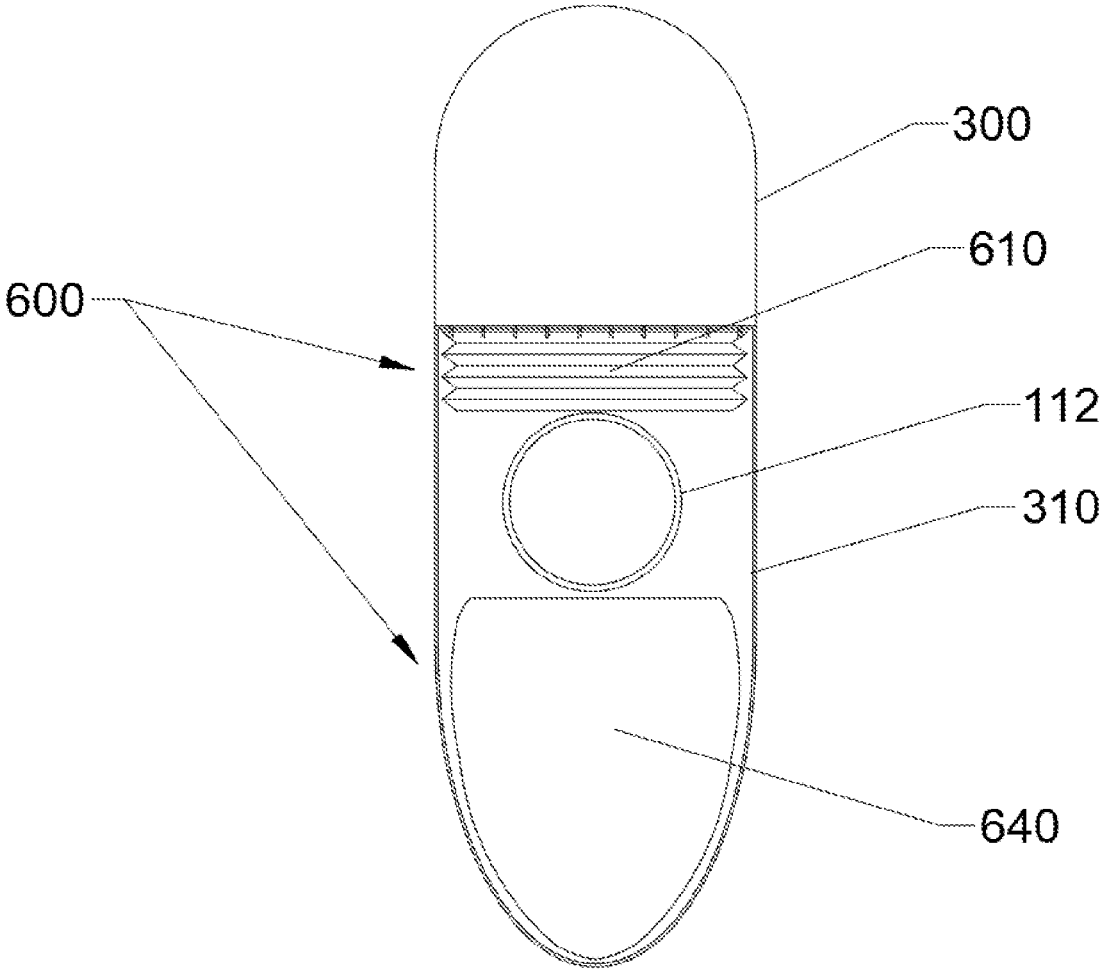
FIG. 12 shows an exemplary embodiment of a sealing system with an inflatable balloon and an inflatable bellows installed.

FIG. 12 shows an exemplary embodiment of optional sealing system 600. A preferred embodiment uses bellows 610 to partially seal one end of skirt 310 and inflatable balloon 640 to partially seal the other end of skirt 310. Any combination of bellows and/or balloons may be used from any side of skirt 310. For example, referring to FIG. 12, additional balloons or bellows could be mounted in the two remaining open sections on each side of exhaust pipe 112. Optionally, inflatable balloon 640 may comprise an exhaust pipe interface section or a stiffening member to provide for durability when touching exhaust pipe 112 and to prevent balloon 640 from wrapping around exhaust pipe 112. Alternatively, balloon may be shaped or include an element to limit the contact between exhaust pipe 112 and bellows 610 or balloon 640, reducing the contact to a point or a line, to reduce the heat path and to reduce the amount of heat transferred from exhaust pipe 112 to bellows 610 or balloon 640.

Figure 13:
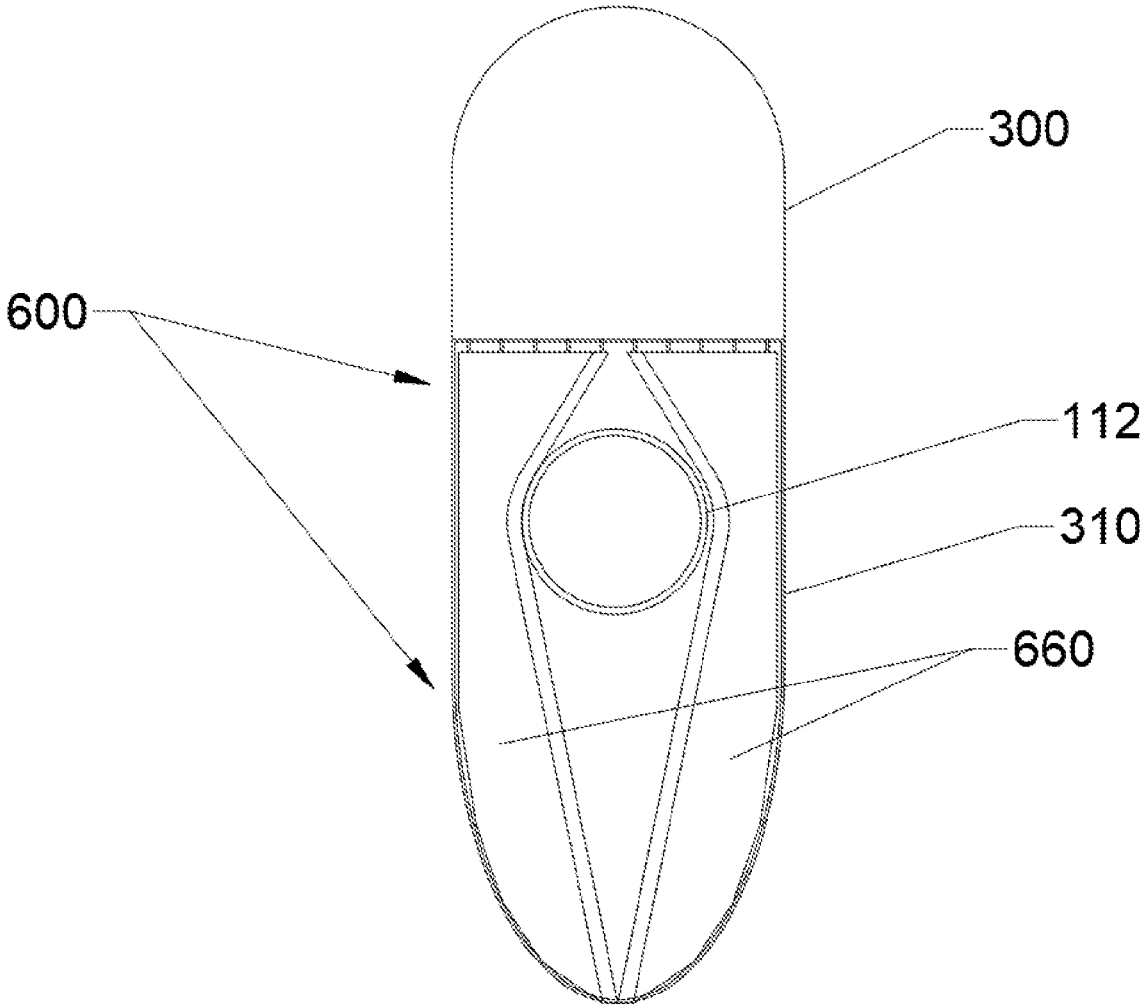
FIG. 13 shows an exemplary embodiment of a sealing system with sealing flaps installed.

FIG. 13 shows another exemplary embodiment of optional sealing system 600. A preferred embodiment uses flaps 660 which contain a seam inside of which a spring is stretched. The spring urges each flap 660 to cover its half the opening of skirt 310 if not otherwise stretched by an exhaust pipe. Flaps 660 in this example are constructed of high temperature fabric.

A combination of inflatable bellows 610, inflatable balloon(s) 640, and/or flaps 660 may be used in a sealing system 600. For example, the devices shown in FIG. 12 and FIG. 13 could be combined into a single sealing system 600 which would contain bellows, balloon, and flap elements. Other means of sealing may be substituted.

REFERENCE NUMERALS

10 Oceangoing Vessel (OGV)
20 OGV Hull
22 OGV Auxiliary engine
24 OGV Auxiliary boiler
30 OGV Superstructure
40 OGV Stack/Funnel
50 Exhaust pipe, as part of a collection within a stack
150 Exhaust gas
300 Oceangoing Vessel Exhaust Pipe Coupling
310 Skirt
314 Top surface
320 Inlet chamber
330 Permeable partition
340 Outlet chamber
342 Outlet/Duct attachment adapter
344 Deflector surface
350 Outlet duct
360 Attachment device
400 Z Duct swivel
420 Z Duct swivel motor
430 Z Duct swivel mounting tab
510 X Actuator
520 Y Actuator
550 Z Actuator
552 Z Actuator push rod
554 Z Actuator cylinder
600 Sealing System
610 Sealing Bellows
640 Sealing Balloon
660 Sealing Flap

OPERATION

FIG. 6 shows the examples of exhaust pipe styles, each superimposed with an installed coupling 300. This figure demonstrates that a wide variety of exhaust pipes styles may be serviced with a single coupling. Note that smaller exhaust pipe diameters may also be accommodated, even down to one quarter or less of the diameter of the exhaust pipes shown in FIG. 6. This figure shows the wide variety of shapes and sizes of exhaust pipes that may be coupled without compromising performance. This is an advantage compared to the prior art in which the exhaust pipe diameter had to be matched to the opening in the connector within a narrow margin.

FIG. 7 shows cross section C-C of coupling 300 used in an example wherein exhaust pipe 112 exits straight up. The converging top aspect of the wedge-shaped inlet chamber 320 directs exhaust pipe 112 into the position shown. During installation, the wedge-shaped inlet chamber 320 also directs exhaust pipe 112 to a secure resting location with plenty of open volume to accommodate exiting exhaust gas 150. The exhaust gas stream exits exhaust pipe 112 in the vertical up direction. The exhaust gas initially impacts the angled aspect at the top surface 314 of inlet section 320 (instead of directly impacting a connected flexible duct). This deflector solves the disadvantage of exhaust gas escaping though flexible duct. The deflected exhaust gas 150 then passes through permeable partition 330 into outlet section 340. Exhaust gas 150 is then deflected again off the deflector surface 344 of outlet chamber 340 such that exhaust gas 150 exits the top outlet of coupling 300 and ultimately into the connecting exhaust gas outlet ducting (not shown in FIG. 7).

FIG. 8 shows cross section D-D of coupling 300 used in an example wherein exhaust pipe 112 is angled-over at about a 45-degree angle. This is the most typical configuration on OGV's. During installation, the wedge-shaped converging top aspect, top surface 314, of inlet chamber 320 directs exhaust pipe 112 into the position shown. Coupling 300 securely rests in this position. Exhaust gas 150 exits the exhaust pipe at a 45-degree angle and passes immediately through permeable partition 330 into outlet chamber 340. The exhaust gas impinges on the deflector surface 344 of outlet chamber 340 (instead of a connected flexible duct) such that exhaust gas 150 is directed to the outlet top of coupling 300 and ultimately into the connecting exhaust gas outlet ducting.

FIG. 9 shows cross section E-E of coupling 300 used in an example wherein exhaust pipe 112 is angled-over at about a 90-degree angle. The exhaust pipe shown is constructed of all straight sections in this example. The wedge-shaped converging top surface 314 of inlet chamber 320 directs exhaust pipe 112 into the position shown. Coupling 300 securely rests in this position. Exhaust gas 150 exits the exhaust pipe at a about a 90-degree angle and passes immediately through permeable partition 330 into outlet chamber 340. The exhaust gas then impinges on deflector surface 344 of outlet chamber 340 (instead of a connected flexible duct) such that the stream of exhaust gas is deflected up and out of outlet chamber 340.

FIG. 10 shows cross section F-F of coupling 300 used in an example wherein exhaust pipe 112 is angled-over at about a 90-degree angle. This example works exactly like the example of FIG. 9, except the exhaust pipe comprises curved pipe. This example simply demonstrates that it does not matter if the exhaust pipe is made with or without curved sections of pipe.

FIG. 11 shows coupling 300 in an example embodiment in which outlet ducting 350 is attached, as well as an example positioning mechanism.

Coupling 300 is considerably simpler to couple onto an angled-over exhaust pipe than the prior art, as fewer degrees of freedom (DOF) are required. The coupling motion may be defined within a Cartesian coordinate system in which the X and Y axes are horizontal, and the Z axis is vertical. The following simple steps are required to install coupling 300 over an angled-over exhaust pipe:

The first step comprises first rotating coupling 300 about the Z axis to roughly align the exhaust pipe exit so that horizontal direction of the exhaust stream is in the same direction as a line drawn from the inlet chamber to outlet chamber. In other words, the exhaust flows in the direction of outlet chamber 340. In the example in FIG. 11, this is accomplished by rotating Z Duct swivel 400. (1 rotational DOF motion)

The second step is to position skirt 310 directly above exhaust pipe 112 within the XY plane. Since the opening of skirt 310 is sufficiently large, this does not have to be a precise positioning, and the wedge-shaped inlet chamber 320 will guide exhaust pipe 112 into position. In the example in FIG. 11, this is accomplished by operating X Actuator 510 and Y Actuator 520. (2 translational DOF motions)

The third step is to lower coupling 300 onto exhaust pipe 112 until it comes to rest. The novel and unique wedge shape of inlet section 320 guides exhaust pipe 112 into position once exhaust pipe 112 is located within the perimeter skirt 310. In the example in FIG. 11, this is accomplished by extending Z Actuator 550. (1 translational DOF motion)

Thus, an advantage of coupling 300 is that it requires only three distinct steps and four degrees of freedom (4DOF) to couple, in which only one DOF needs to be operated at a time, which is considerably simpler than in the prior art which required 6DOF concurrently. Thus, the simple positioning mechanism shown in FIG. 11 or a simple crane mechanism could be used instead of a 6DOF robotic arm. As a result, the simplicity of the coupling method provides another advantage in that it is suitable for remote coupling using a simple rotating/translating/lowering mechanism. Note that if the operator is skilled, the operator could operate multiple motions at the same time if desired. However, an advantage of coupling 300 is that it does not require a skilled operator to operate remotely.

Thus, an advantage of coupling 300 is that the unique wedge shape of inlet chamber 320 in combination with permeable partition 330 is that it guides the exhaust pipe into the optimum location within coupling 300 with a simple lowering motion. Installation of coupling 300 does not require manual manipulation installation and/or removal by personnel at the exhaust pipe. Coupling 300 enables remote installation and/or removal and is thus advantageous in reducing the amount of time required to couple and decouple, which results in increased overall connected time which increases the amount of emissions treated. Furthermore, remote coupling and decoupling is advantageous because of the reduction of danger to personnel because personnel are not required to manually manipulate the coupling.

X actuator 510 and Y actuator 520 as disclosed in FIG. 11 of this exemplary embodiment are rotary hydraulic actuators. The hydraulic pressure is controlled such that the maximum force that may be imparted in a collision of coupling 300 with another object is limited. This prevents damage to coupling 300 or to another object if a collision where to occur. Once coupling 300 is installed onto its exhaust pipe, both actuators are "short circuited" such that the hydraulic inlet and outlets are in fluid communication with each other. This has an effect of allowing both actuators to be freely moved by the motions of coupling 300 once installed on the moving vessel. Thus, there are two modes of operation: a) positioning mode and b) compliant mode. The compliant mode is the default mode of operation and when the system is off.

Z actuator 550 as disclosed in FIG. 11 of this exemplary embodiment is a hydraulic linear actuator. Actuator 550 may be actuated with pressurized gas or alternatively with hydraulics. The pressure is controlled to limit the force that may be imparted in a collision of coupling 300 with another object is limited to prevent damage to coupling 300 or to the other object if a collision occurs. Once coupling 300 is installed onto its exhaust pipe, an adjustable pressure is maintained on Z actuator 550 such that a small downward or upward force is continually applied while coupling 300 is in operation. This has the advantage of allowing coupling 300 top move up and down freely, but also helps to maintain a pressure to help maintain coupling 300 in position. The default mode of operation is such that coupling 300 drifts up and locks in the up position when off.

All three actuators (X actuator 510, Y actuator 520, and Z actuator 550) in this exemplary embodiment are instrumented with position feedback. Thus, the precise position of each coupling 300 may be monitored by the control system such that impending extremes of motion may be signaled to the operator(s). This has the advantage of enabling continual monitoring of the relative locations of each coupling 300 by a control system. Thus, when an OGV raises or lowers in response to cargo loading and unloading, an operator may decide to periodically adjust the location of the main arm in response to changing conditions to center the oscillatory motions of all the couplings being utilized.

The positioning mechanism disclosed in FIG. 11 is a simple, dedicated mechanism that remains in place even after coupling 300 is installed. Thus, a dedicated positioning mechanism for each coupling is an advantage compared to a single robotic arm as follows:

a) Each coupling is always secured and attached and can always be retrieved.

b) Each coupling is supported by a gentle force to help maintain its position on each exhaust pipe.

c) The relative position of each coupling is constantly monitored by the control system and the operator may be informed by an alarm if the relative positions of the coupling(s) begin to drift.

d) Each coupling does not have to captured prior to beginning an installation process.

e) Each coupling does not have to be captured prior to beginning an extraction process.

Coupling 300 completely encloses exhaust pipe 112, unlike prior fume hoods that stood off at some distance resulting in ingested outside air. This results in the advantage of less total gas that must be processed by the treatment system, resulting in smaller ducting and treatment system, thus reducing capital cost and operating cost.

Yet another advantage of coupling 300 is that combination of the aforementioned unique wedge shape of inlet section 320 and permeable partition 330 in combination with a balanced weight distribution maintains coupling 300 on top of exhaust pipe 112 without additional grasping or securing apparatus to maintain the hood on top of the exhaust pipe. Thus, gravity alone is sufficient to maintain the coupling of coupling 300 to exhaust pipe 112. This is an advantage compared to simple fume extraction hoods in which the proper orientation of the collection hood had to be maintained relative to the exhaust pipe using additional mechanisms and controls.

Furthermore, the unique wedge shape of inlet section 320 and outlet section 340 deflects the exhaust stream toward the axis of outlet 342. This has the advantage of preventing loss of exhaust gas out of skirt 310 because the momentum of the gas is deflected away from the opening of skirt 310. Furthermore, exhaust gas does not directly impinge on the walls of a fabric outlet duct attached to outlet 342. Otherwise, if exhaust gas were to directly impinge on the walls of the fabric duct, exhaust gas would be lost through the permeable fabric wall of the duct. Furthermore, if exhaust gas were to otherwise directly impinge on the walls of the fabric duct, the duct would be damaged from excessive heat. Thus, the deflection of exhaust gas caused by the shape of inlet chamber 320 and/or outlet chamber 340 provides an advantage of increased the capture efficiency by preventing loss of exhaust gas through the fabric conduit. A further advantage is the prevention of damage to the outlet duct.

A further advantage of coupling 300 is that it is suitable for use with angled-over exhaust pipes, not just vertical-exit exhaust pipes as in prior fume hoods. Any style of exhaust pipe may be accommodated from vertical-exit to bent-over by 90 degrees. Regardless of the exhaust pipe style, the exhaust gas stream is deflected toward outlet 342.

FIG. 12 and FIG. 13 show an optional exemplary embodiment of a sealing system to partially seal the gap between exhaust pipe 112 and skirt 310. The sealing means may be, for example, at least one inflatable balloon 640 and/or at least one inflatable bellows 610 and/or at least one flap 660. In the case of flap 660, the space may be filled with a resilient barrier made of high temperature fabric such that the barrier is pushed to the side as an exhaust pipe enters the area of skirt 310 while maintaining contact with the exhaust pipe. This is accomplished by means of a seam in which a spring is stretched through it. Alternatively, flap 660 could also be bristles pointing toward each other with an opening down the middle.

Inflatable bellows 610 and inflatable balloon 640 may be actuated, once exhaust pipe 112 is in position, with pressurized gas or compressed air via a remote solenoid, for example. The pressurized gas would be allowed to fill the bellows or balloon at a pressure sufficient to maintain a shape that fills the intended gap. To release bellows 610 or balloon 640, the pressure may be released, or alternately a vacuum may be applied to evacuate the gas within bellows 610 or balloon 640. Use of a vacuum would have the effect of flattening the bellows or balloon to the side of walls of skirt 310 which would maximize the opening for easy installation or removal of exhaust pipe 112.

Optional sealing system 600 may improve the capture efficiency of coupling 300 by providing resistance to escaping exhaust gas and may reduce the amount of outside air ingested by providing resistance to incoming air. Note that the purpose of optional sealing system 600 is not to assert any mechanical force to retain coupling 300 onto exhaust pipe 112, because coupling 300 is already mechanically stable on top of exhaust pipe 112 due to the force of gravity in conjunction with the novel shape of chamber 310. Furthermore, optional sealing system 600 may fall short of contacting exhaust pipe 112, but instead only partially fill the area to provide a resistance to air to entering or exhaust to exiting coupling 300. Alternatively, optional sealing system 600 may be used to at least partially seal coupling 300 when not installed on an exhaust pipe 112. This feature would provide the benefit of preventing outside air from being ingested when coupling 300 is not in use, especially if the coupling is one of several couplings that are ultimately connected to the same treatment system.

The above description is intended to enable the person skilled in the art to practice the invention. It is not intended to detail all of the possible modifications and variations that will become apparent to the skilled worker upon reading the description. It is intended, however, that all such modifications and variations be included within the scope of the invention that is seen in the above description and otherwise defined by the following claims.

CONCLUSION, RAMIFICATIONS, AND SCOPE

Accordingly, several advantages of one or more aspects are as follows:

(a) Does not require a single robotic arm (b) Does not require a manlift (c) Does not require boarding the OGV in order to install the connector(s).

(d) Reduces the amount of time required in order to connect and disconnect.

(e) Eliminates the burn hazard that exists with manual manipulation of connectors.

(f) Eliminates the falling hazard that exists when a temporary ladder is used during manual manipulation.

(g) Eliminates the falling hazard that exists when a person climbs up on stack infrastructure in order to reach the top of the exhaust pipe during installation and removal of connectors.

(h) Eliminates the hazard of breathing noxious fumes when the person(s) are near the exhaust pipes.

(i) Compared to a whole-stack bonnet, it not large and cumbersome.

(j) Easy to maneuver as compared to a large whole-stack bonnet.

(k) Less chance of impact with nearby vessel structures than a large whole-stack bonnet. Any impacts that still occur cause significantly less damage.

(l) Higher capture efficiency through the prevention of leaking exhaust gas.

(m) Increased system performance due to the prevention of dilution of the exhaust gas from the admission of outside air.

(n) Dedicated positioning mechanism prevents coupling from falling off the exhaust pipe and becoming irretrievable.

(o) Dedicated positioning mechanism allows direct monitoring of relative coupling position, which may be hard-wired to warnings and alarms in the control system.

(p) Prevents heat damage to the flexible duct connected to the coupling because the novel and unique shape of the coupling prevents the exhaust gas from directly impinging the wall of the flexible duct regardless of the type of exit on the exhaust pipe.

(q) Capture efficiency is increased because the novel and unique shape of the coupling directs the exhaust gas down the axis of the attached outlet duct instead of through the side walls of a flexible duct.

(r) Capture efficiency is increased because the novel and unique shape of the coupling directs the exhaust gas down the axis of the attached outlet duct instead reflecting the exhaust gas stream out of the coupling.

(s) Compatible with all shapes of exhaust pipes.

(t) Compatible with all diameters of exhaust pipes that are less than the maximum design size without the need for reconfiguration of the coupling. Different couplings do not have to be used for different exhaust pipe diameters.

(u) Compatible with both round or oval exhaust pipe exit shapes.

(v) Compatible with exhaust pipes with flame arrestor cages which prevent penetration of any object into the exhaust pipe, thus enabling use on the entire tanker class of vessels and other vessels that utilize a flame arrestor cage.

(w) Increased reliability because fabric is not in direct contact with the exhaust pipe, thus reducing the eliminating the need to periodically replace fabric components.

(x) Compatibility with exhaust pipes that use flame arrestors which are incompatible with fabric sleeves because fabric snags on the cage.

(y) Does not require actuators mounted on the coupling, which cannot endure the high temperatures associated with the close proximity of the exhaust pipe.

(z) Dedicated positioning mechanisms for each coupling is an advantage compared to a single robotic arm as follows:

a. Each coupling is always secured and can always be retrieved.

b. Each coupling is supported by a gentle force to help maintain its position on each exhaust pipe.

c. The relative position of each coupling may be constantly monitored by the control system and the operator may be informed by an alarm if the relative positions of the coupling(s) begin to drift excessively.

d. Each coupling does not have to be captured prior to beginning an installation process.

e. Each coupling does not have to be captured prior to beginning an extraction process.

RAMIFICATIONS

The materials of construction in this exemplary embodiment may also be any form of stainless steel, titanium, or another metal, fabric, or plastic suitable for exhaust temperatures exceeding 1,000 degrees Fahrenheit. Some aspects of coupling 300 may be different from other aspects. For example, the surfaces that deflect exhaust gas may be best suited for metals, whereas other surfaces not subject to exhaust gas stream impact or contact with the exhaust pipe may be plastic or fabric. For example, skirt 310 could be made of fabric in order to save weight. Skirt 310 could also be partially open in some areas.

Other methods of fabrication could be used for at least some aspects of coupling 300, for example, such as deep drawing metal, casting, or molding.

I claim:

1. An exhaust pipe coupling configured to temporarily couple to an exhaust pipe of an oceangoing vessel, the exhaust pipe coupling comprising:

a container with an inlet chamber and an outlet chamber, with said inlet and outlet chambers separated by a permeable partition configured to allow exhaust gas flow from the inlet chamber into the outlet chamber;

wherein said inlet chamber is wedge-shaped, oriented with a wide aspect extending in a downward direction, with an inlet opening at a bottom of the container sufficiently large to fit over a top aspect of the exhaust pipe and configured to receive the top aspect of the exhaust pipe within the inlet chamber through the inlet opening to temporarily couple to the exhaust pipe;

wherein said permeable partition constrains the exhaust pipe within said inlet chamber while also providing a path for exhaust gas flow emitted from the exhaust pipe to pass from said inlet chamber to said outlet chamber;

wherein said outlet chamber is wedge-shaped, with a wide aspect extending upwardly, with an outlet at a top of the outlet chamber for providing an exit for said exhaust gas flow.

2. The exhaust pipe coupling of claim 1, wherein said outlet is configured for attachment to an exhaust duct.

3. The exhaust pipe coupling of claim 1, wherein said exhaust gas flow exits said exhaust pipe in a direction between vertical and horizontal, wherein a horizontal component of said exhaust gas flow is oriented toward said outlet chamber.

4. The exhaust pipe coupling of claim 1, wherein said outlet chamber is shaped to deflect a horizontal component of said exhaust gas flow towards said outlet.

5. The exhaust pipe coupling of claim 1, wherein said inlet chamber is shaped to deflect a vertical component of said exhaust gas flow towards said outlet.

6. The exhaust pipe coupling of claim 1, wherein a top surface of said inlet chamber is shaped to center said exhaust pipe coupling on top of the exhaust pipe, wherein said top surface of said inlet chamber is further shaped to constrain the exhaust pipe in a narrower aspect of said inlet chamber.

7. The exhaust pipe coupling of claim 1, wherein said exhaust pipe coupling further comprises a seal structure configured to seal an area between the exhaust pipe and said inlet chamber, thereby preventing an amount of said exhaust gas flow from escaping through said area between said exhaust pipe and said inlet chamber.

8. A system comprising:

the exhaust pipe coupling of claim 1; and a positioning system configured to position said exhaust pipe coupling over the exhaust pipe and to lower said exhaust pipe coupling over the exhaust pipe.

9. The system of claim 8, wherein the positioning system comprises hydraulic actuators configured to selectively either urge said coupling over the exhaust pipe or to provide a force to maintain said coupling over the exhaust pipe.

10. The exhaust pipe coupling of claim 1, wherein said exhaust pipe is part of an internal combustion engine exhaust system on the oceangoing vessel.

11. The exhaust pipe coupling of claim 1, wherein said exhaust pipe is part of a boiler exhaust system on the oceangoing vessel.

12. The exhaust pipe coupling of claim 1, wherein the permeable partition comprises a vertical grid of spaced vertical elongated rigid members configured to make contact with the exhaust pipe during installation on the exhaust pipe.

13. The exhaust pipe coupling of claim 1, wherein:

the inlet opening of the inlet chamber is vertically offset from the outlet of the outlet chamber, with the exhaust pipe coupling temporarily coupled to the exhaust pipe of the oceangoing vessel.

14. The exhaust pipe coupling of claim 13, further comprising an attachment device located near a center of mass of the exhaust pipe coupling such that the exhaust pipe coupling hangs level when lifted by the attachment device.

15. An exhaust pipe coupling configured to temporarily couple to an exhaust pipe of an oceangoing vessel, the exhaust pipe coupling having a center of mass and comprising:

an inlet chamber comprising an inlet skirt defining an inlet opening;

an outlet chamber having an outlet;

the inlet opening of the inlet chamber vertically offset from the outlet of the outlet chamber;

a permeable partition between the inlet chamber and the outlet chamber and configured to pass exhaust gas from the exhaust pipe from the inlet chamber to the outlet chamber; and an attachment device located near the center of mass of the exhaust pipe coupling such that the exhaust pipe coupling hangs level when lifted by the attachment device;

wherein the inlet chamber has a rounded top surface to match a shape of mating one or more exhaust pipes of the oceangoing vessel, or a triangular or flat top surface, the inlet chamber configured to temporarily receive an end of the exhaust pipe.

16. The exhaust pipe coupling of claim 15, wherein the permeable partition comprises a vertical grid of spaced elongated elements.

17. The exhaust pipe coupling of claim 15, wherein the inlet opening and the inlet chamber are configured to operate with and receive a plurality of exhaust pipe outlet configurations, including straight-up vertical to angled-over horizontal.

18. The exhaust pipe coupling of claim 15, wherein the exhaust pipe extends from the ocean-going vessel.

19. A coupling system configured to temporarily couple an exhaust coupling to an oceangoing vessel exhaust pipe, the coupling system comprising:

an exhaust coupling;

a mechanism with three translational degrees of freedom and only one rotational degree of freedom to position the exhaust coupling over the exhaust pipe;

the exhaust coupling configured for use with a plurality of exhaust pipe shapes and sizes, the exhaust coupling comprising a two-chamber configuration, including an inlet chamber and an outlet chamber separated by a permeable partition;

the exhaust coupling having a wedge shape of said inlet chamber which enables a stable and balanced resting position on top of the exhaust pipe, the inlet and outlet chambers configured to deflect an exhaust gas stream entering an inlet opening of the inlet chamber towards an outlet opening of the outlet chamber of the coupling, regardless of exhaust pipe shape.

20. The coupling system of claim 19, wherein:

the inlet opening of the inlet chamber is vertically offset from the outlet of the outlet chamber with the exhaust pipe coupling temporarily coupled to the exhaust pipe of the oceangoing vessel.

* * * * *